US012716310B2

(12) United States Patent
Pritchard

(10) Patent No.: US 12,716,310 B2
(45) Date of Patent: Aug. 25, 2026

(54) TEXTILE WELL COVER

(71) Applicant: Cameron Holland Pritchard, Scottsville, VA (US)

(72) Inventor: Cameron Holland Pritchard, Scottsville, VA (US)

( * ) Notice: Subject to any disclaimer, the term of this patent is extended or adjusted under 35 U.S.C. 154(b) by 12 days.

(21) Appl. No.: 19/000,627

(22) Filed: Dec. 23, 2024

(65) Prior Publication Data

US 2025/0215761 A1 Jul. 3, 2025

Related U.S. Application Data

(60) Provisional application No. 63/615,232, filed on Dec. 27, 2023.

(51) Int. Cl.
*E21B 33/03* (2006.01)

(52) U.S. Cl.
CPC ..... *E21B 33/03* (2013.01)

(58) Field of Classification Search
CPC ..... E21B 33/03; E02D 29/14
See application file for complete search history.

(56) References Cited

U.S. PATENT DOCUMENTS 2,365,888 A * 12/1944 Linderfelt ..... B65D 59/06 138/96 R
2,371,913 A * 3/1945 Phillips ..... B65D 59/06 174/138 F
2,708,950 A * 5/1955 Averett ..... B65D 59/06 24/567
2,942,625 A * 6/1960 Costanzo ..... B65D 59/06 D23/260
3,587,654 A * 6/1971 Yocum ..... B65D 59/06 220/279
3,713,463 A * 1/1973 Bywater, Jr. ..... F16L 55/10 138/96 T
3,756,314 A 9/1973 Valley
3,962,554 A * 6/1976 Eigel ..... H02G 15/06 174/74 A
4,021,131 A 5/1977 Bakken et al.
4,158,407 A * 6/1979 Rest ..... B65D 59/00 295/36.1
4,168,726 A * 9/1979 Klennert ..... F16L 59/02 454/367
4,847,447 A * 7/1989 Eiswirth ..... H02G 1/081 174/79
4,848,458 A * 7/1989 Holdsworth ..... E21B 33/03 166/93.1
4,905,764 A 3/1990 Laput
4,982,054 A * 1/1991 De Bruycker ..... H02G 15/076 174/74 A
5,074,022 A * 12/1991 Bussert ..... E06B 9/24 29/525

(Continued)

*Primary Examiner* — Daniel P Stephenson

(57) ABSTRACT

To address the issues posed by the current methods of aesthetic improvement to water well(s) (head/casing). An innovative, adaptive, one size fits most textile solution designed to harmonize/blend a water well (head/casing) to its respective surroundings is a must for those who care about the aesthetic appeal of their property. The textile well cover listed herein offers a safe, size conforming, time friendly and economical solution to those simply trying to harmonize/blend their unsightly water well (head/casing) with its respective surroundings.

9 Claims, 4 Drawing Sheets

(56) References Cited

U.S. PATENT DOCUMENTS 5,145,283 A * 9/1992 Gowen ..... B65D 59/00 405/184.5
5,395,682 A * 3/1995 Holland ..... D03D 1/0041 442/247
5,516,985 A * 5/1996 Merkel ..... H02G 15/043 174/74 A
5,685,343 A * 11/1997 Smith ..... A47G 7/04 166/94.1
5,687,773 A * 11/1997 Ryan ..... F01N 13/085 138/89.4
5,915,899 A * 6/1999 Dennis ..... B60P 7/0823 410/97
5,965,223 A * 10/1999 Andrews ..... D02G 3/442 428/36.1
6,032,697 A * 3/2000 Kennedy ..... E03C 1/122 138/89.4
6,102,076 A * 8/2000 Romero, Jr. ..... F01N 13/085 138/128
6,131,654 A 10/2000 Holscher
6,248,411 B1 6/2001 Warfel
6,332,478 B1 * 12/2001 Holden ..... F16L 57/005 138/109
6,369,329 B1 * 4/2002 Moore ..... H02G 15/043 174/74 A
D493,517 S * 7/2004 Legg ..... D23/386
6,874,541 B2 * 4/2005 Vossen ..... F24F 13/20 138/89.4
7,723,622 B2 * 5/2010 Dukes ..... H02G 3/22 16/2.2
7,900,654 B2 * 3/2011 Moreau ..... F16L 55/115 138/89
8,502,069 B2 * 8/2013 Holland ..... H02G 15/18 57/212
D747,437 S 1/2016 Thomason
9,995,100 B1 * 6/2018 Bogush ..... E21B 33/00
D903,837 S * 12/2020 Hughes ..... D23/266
12,123,538 B2 * 10/2024 Midgett ..... F16L 57/005
2002/0170728 A1 * 11/2002 Holland ..... H01B 7/28 174/19
2003/0010726 A1 * 1/2003 Zins ..... E02B 3/12 210/435
2005/0011566 A1 * 1/2005 Schritter ..... F16L 55/1141 138/109
2007/0144600 A1 * 6/2007 Moreau ..... F16L 55/07 138/90
2007/0171644 A1 * 7/2007 Seibel ..... F21V 21/10 362/249.01
2015/0238037 A1 8/2015 Unser
2025/0215761 A1 * 7/2025 Pritchard ..... E21B 33/03

* cited by examiner

TEXTILE WELL COVER

FIELD OF INVENTION

This invention pertains generally to the field of covering a water well (head/casing) despite large variations in size, and specifically to harmonize/blend the water well (head/casing) with its surroundings, elevating aesthetic appeal.

BACKGROUND

Water well (head/casings) are commonly found across the U.S to provide portable water for residential and commercial properties alike. One common complaint is that said water well (heads/casings) are frequently placed in unsightly locations (i.e. in the front yard of property). While there are a few well covers amongst the prior art, they vary greatly. Some are designed to protect from damage and/or insulate the water well (head/casing) to prevent the water from freezing: (U.S. Pat. No. 3,756,314A, 4,905,764A). Others to increase aesthetic appeal are available, however, they are unfortunately time consuming, laborious, ineffective and/or economically impractical. Current options include: Purchasing a rigid hollow faux rock (U.S. Pat. Nos. 6,131,654A, 4,021,131A, 6,248,411B1) [economically impractical & adds a presence to said water well (head/casing) instead of harmonizing/blending with its respective surroundings], purchasing a rigid often wooden structure that makes the water well (head/casing) appear as a larger and traditional styled "draw well" or "well and bucket" (US20150238037A1) [economically impractical & adds a presence to said water well head/casing instead of harmonizing/blending with its respective surroundings], painting the water well (head/casing) to harmonize/blend with its respective surroundings [time consuming, laborious & involves chemical exposure], and lastly plant flora around water well (head/casing) [time consuming, laborious & adds a presence to said water well (head/casing)]. The closest prior art uncovered is a well cover that has the ornamental look of tree bark (U.S. D747437S1) however, its limiting and still lacks the utility of being able to accommodate the large variation in water well (head/casing) sizes.

Thus there currently remains a need for improved water well covers that would address these problems by utilizing a flexible textile membrane to achieve a one size fits most solution.

SUMMARY

Accordingly, it is one objective of the present invention to describe a water well (head/casing) cover which utilizes a flexible textile membrane to enable adaptability.

It is another objective of the present invention to describe the way the excess length of the water well (head/casing) textile cover is concealed within the cover by rolling/folding within its self.

It is yet another objective of the present invention to describe how utilizing a dyed and or colored textile membrane assists with the harmonization/blending of said textile well cover with its respective surroundings.

Further objectives and advantages of the invention will become apparent from consideration of the figures and ensuing descriptions.

DETAILED DESCRIPTION

Figure 1:
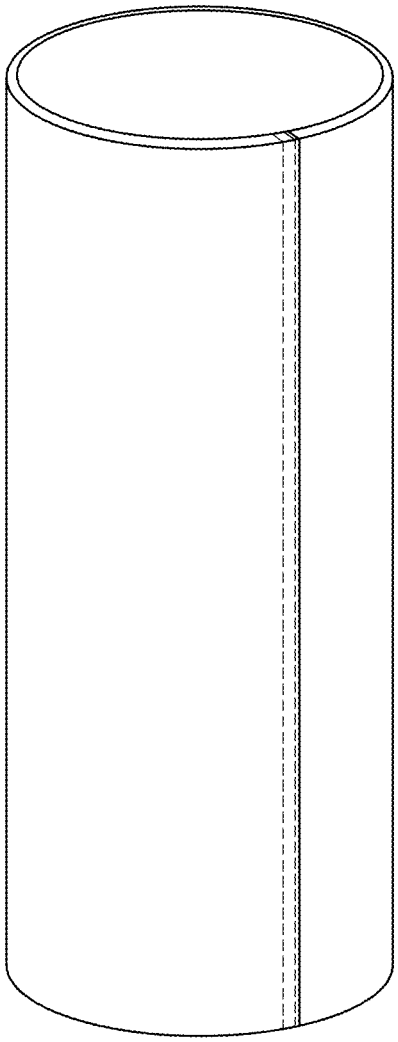
FIG. 1 is a front perspective view of a textile well cover according to one embodiment of the present disclosure.
Figure 2:
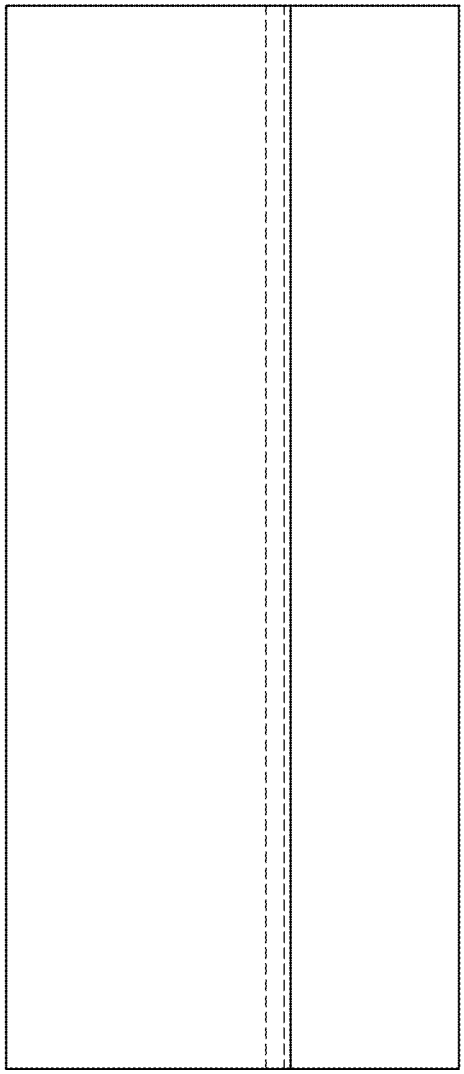
FIG. 2 is a side view of the textile well cover of FIG. 1.
Figure 3:
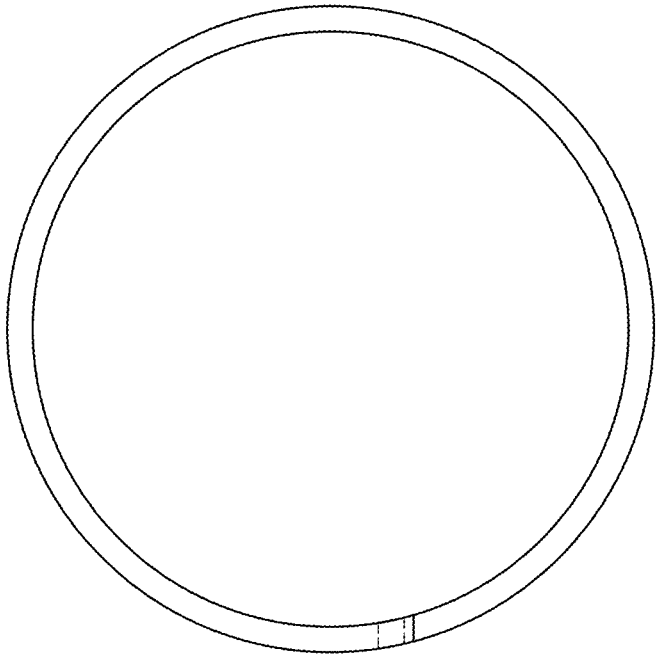
FIG. 3 is a top view of the textile well cover of FIG. 1. Showing cut and sewn circular top.
Figure 4:
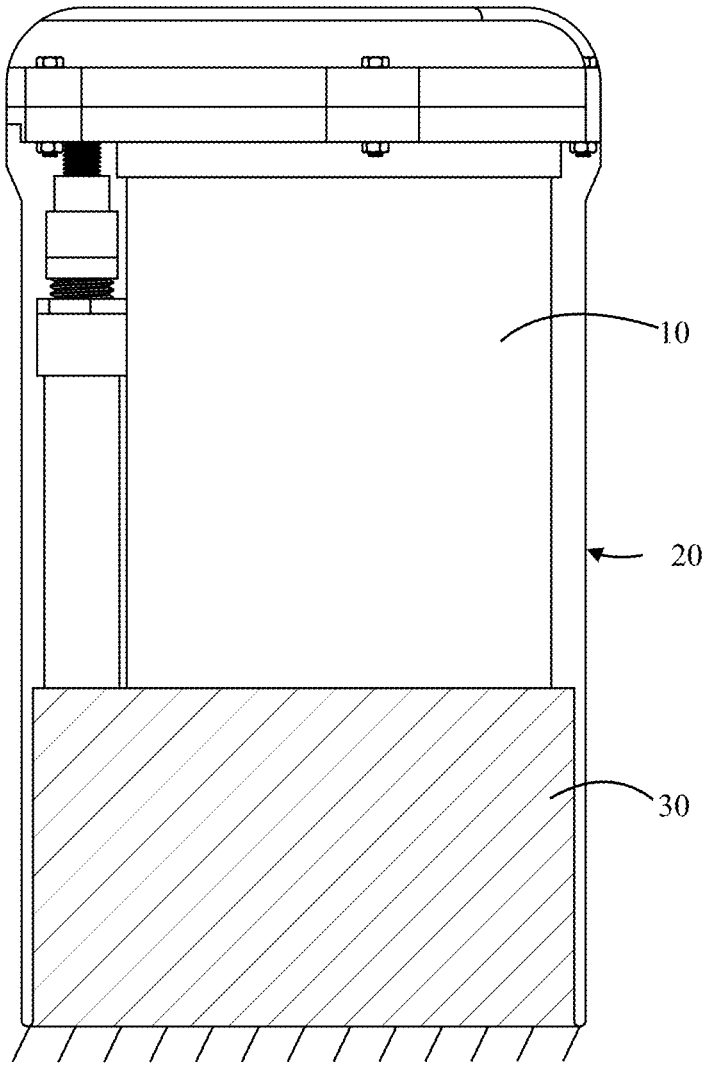
FIG. 4 is a cross-sectional view of the textile well cover of FIG. 1 (20) installed on/over a typical modern day water well (head/casing) (10). Showing excess textile material folded within (30).

It should, of course, be understood that the description and drawings herein are merely illustrative and that various modifications and changes can be made in the structures disclosed without departing from the scope of the appended claims. It will also be appreciated that the various identified components of the exemplary textile well cover disclosed herein are merely terms of art that may vary from one manufacturer to another and should not be deemed to limit the present disclosure. The disclosed invention addresses issues posed by current water well cover options by providing a safe, adaptive, time friendly and economical option to harmonize/blend these unsightly water well (heads/casings) (FIG. 4, 10) with their respective surroundings by utilizing a flexible textile membrane sewn into a cylindrical figure (FIG. 1), with a cut and sewn flush circular top (FIG. 3). I have found that a textile membrane comprising of a double knit polyester and spandex blend is the best material to utilize for this purpose. I have also found that a cover with a circumference of 25 inches and height/length of 36 inches is ideal. Given the fact water wells (head/casing) vary greatly in size, the flexible textile composition allows for the variation of girth/circumference. The excess length of the flexible textile membrane is concealed by rolling/folding the excess material within the textile well cover (FIG. 4, 30); this design allows for the variation in height of said water well (head/casing). By utilizing dye and/or color from other sources, the textile membrane is able to harmonize/blend with its respective surroundings, EX; green to blend with grass, brown to bend with mulch/dead leaves, etc.

While the described embodiment represents a currently envisioned best mode, it is presented for illustrative purposes and not to be construed as limiting. In one aspect, the device may compromise a folded & stitched top. In another aspect the device may comprise a flush circular top (FIG. 3). Other embodiments may comprise zipper(s), snap(s), button (s), hook and loop fastener(s) to achieve a fitted look when utilizing a textile membrane that is less than ideal in terms of flexibility and adaptive qualities. It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

The invention claimed is:

1. A textile cover for concealing a water well casing, comprising a stretchable, elastic textile material configured to adapt to variations in circumference and height of water well casings solely by inherent elasticity and frictional engagement of the textile material, without drawstrings, cords, straps, clamps, or mechanical fasteners.

2. The textile cover of claim 1, wherein excess length is accommodated by folds or pleats retained solely by elastic compression and friction, without supplemental cords, straps, or clamps.

3. The textile cover of claim 2, wherein retention of excess textile length is achieved solely by tension and compressive forces of the elastic textile material, without external fasteners or tightening devices.

4. The textile cover of claim 1, wherein the textile is dyed or patterned to visually mimic natural landscaping materials including mulch, grass, or stone.

5. A method comprising positioning a cylindrical textile cover over a water well casing, folding or rolling excess length to form a concealed double layered section retained solely by inherent elasticity and friction of the textile material without cords, straps, or mechanical fasteners, and adjusting height to ensure a cohesive and complete fit.

6. The method of claim 5, further comprising aligning and smoothing the folded section to maintain a uniform exterior.

7. The method of claim 5, wherein the textile cover comprises a flexible, stretchable textile material configured to adapt to varying circumferences.

8. The method of claim 5, wherein the folded or rolled section is retained by inherent friction or tension in the textile material.

9. The method of claim 5, further comprising coloring the textile cover to harmonize with its surroundings.

* * * * *